US009234529B2

(12) United States Patent
Meuter et al.

(10) Patent No.: US 9,234,529 B2
(45) Date of Patent: Jan. 12, 2016

(54) HELICO-AXIAL PUMP, ROTOR FOR A HELICO-AXIAL PUMP AS WELL AS METHOD FOR JOURNALLING A ROTOR IN A HELICO-AXIAL PUMP

(75) Inventors: Paul Meuter, Seuzach (CH); Thomas Welschinger, Radolfzell (DE)

(73) Assignee: SULZER MANAGEMENT AG, Winterthur (CH)

( * ) Notice: Subject to any disclaimer, the term of this patent is extended or adjusted under 35 U.S.C. 154(b) by 1224 days.

(21) Appl. No.: 13/090,704

(22) Filed: Apr. 20, 2011

(65) Prior Publication Data

US 2011/0280741 A1 Nov. 17, 2011

(30) Foreign Application Priority Data

May 11, 2010 (EP) ..... 10162520

(51) Int. Cl.
*F04D 29/66* (2006.01)
*F04D 29/047* (2006.01)
(Continued)

(52) U.S. Cl.
CPC ..... *F04D 29/668* (2013.01); *F04D 29/047* (2013.01); *F04D 29/057* (2013.01); *F04D 29/669* (2013.01); *F04D 31/00* (2013.01)

(58) Field of Classification Search
CPC ..... F01D 1/026; F01D 1/02; F01D 1/34; F01D 5/06; F04D 3/00; F04D 19/002; F04D 19/02; F04D 19/007
USPC ..... 415/198.1, 199.1, 199.2, 199.3, 199.4, 415/199.5; 416/198 R, 201 R, 201 A, 198 A
See application file for complete search history.

(56) References Cited

U.S. PATENT DOCUMENTS 4,606,700 A * 8/1986 Brudny-Chelyadinov et al. ..... 415/199.5
5,253,977 A * 10/1993 Chaix ..... 415/199.5
(Continued)

FOREIGN PATENT DOCUMENTS

EP 0486877 A1 5/1992
GB 1561454 A 2/1980
(Continued)

OTHER PUBLICATIONS

Prouvost, H., "La Pompe P302 Poseidon Essais et Exploitation" Petrole Et Techniques, Association Francaise Des Techniciens Du Petrole, Paris, France Nr. 417, pp. 99-103 (Nov. 1, 1998).

*Primary Examiner* — Edward Look
*Assistant Examiner* — Christopher J Hargitt
(74) *Attorney, Agent, or Firm* — Kilpatrick Townsend & Stockton LLP

(57) ABSTRACT

The invention relates to a helico-axial pump (1) for conveying a multiphase mixture (M), which helico-axial pump (1) includes a rotor (2) rotatably journalled about a longitudinal axis (A) in a pump housing (6) and having a first part rotor (21) and a second part rotor (22), wherein the first part rotor (21) and the second part rotor (22) include a compression stage (K, K1E, K1A, K2E K2A) having a helico-axial impeller (3) and a stator (4) for the compression of the multiphase mixture (M). In accordance with the invention, a hydrodynamic stabilization bush (70) having a stabilization surface (700) is provided and formed between the first part rotor (21) and the second part rotor (22) such that a stabilization gap (8) is formed before the stabilization surface (700) so that a hydrodynamic stabilization layer (S) is formed from a stabilization medium (M) in the stabilization gap (8) in the operating state. The invention further relates to a rotor (2) for a helico-axial pump (1), to a hybrid pump having a rotor (2) for a helico-axial pump (1) as well as to a method for the hydrodynamic journalling of a rotor (2) of a helico-axial pump (1).

15 Claims, 11 Drawing Sheets

Figure 1A:
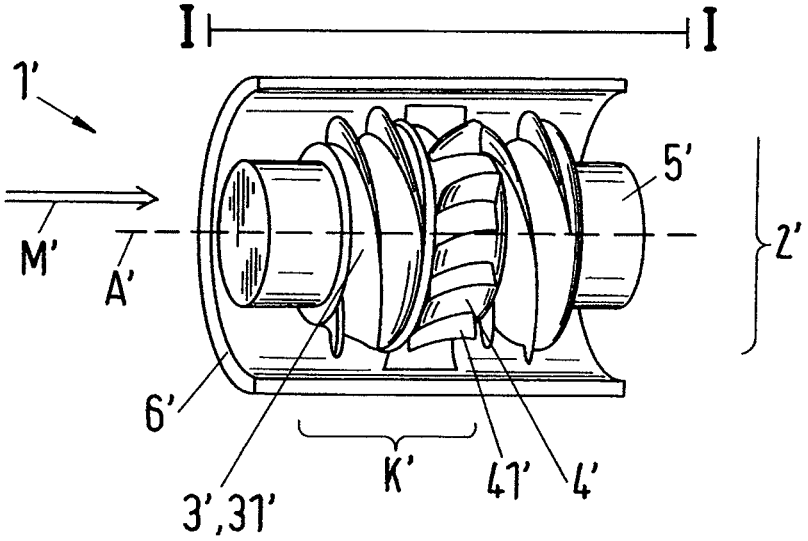

(51) Int. Cl.
*F04D 29/057* (2006.01)
*F04D 31/00* (2006.01)

(56) References Cited

U.S. PATENT DOCUMENTS 5,445,494 A 8/1995 Hanson
5,961,282 A 10/1999 Wittrisch et al.
6,416,225 B1 * 7/2002 Cioceanu et al. ..... 384/97
2002/0187037 A1 12/2002 Lee
2004/0247433 A1 * 12/2004 Haje et al. ..... 415/198.1
2004/0258518 A1 12/2004 Buchanan

FOREIGN PATENT DOCUMENTS

WO WO 99/06711 A1 2/1999
WO WO 99/27256 A1 6/1999

* cited by examiner

HELICO-AXIAL PUMP, ROTOR FOR A HELICO-AXIAL PUMP AS WELL AS METHOD FOR JOURNALLING A ROTOR IN A HELICO-AXIAL PUMP

CROSS REFERENCE TO RELATED APPLICATIONS

This application claims the priority of European Application No. 10 162 520.0, filed on May 11, 2010, the disclosure of which is incorporated herein by reference.

The invention relates to a helico-axial pump for conveying multiphase mixtures, to a rotor for a helico-axial pump, to a hybrid pump having a helico-axial pump as well as to a method for journalling a rotor in a helico-axial pump in accordance with the preamble of independent claims 1, 10, 13 and 14.

The problem occurs in the conveying of multiphase mixtures such as crude oil, which also contains natural gas and frequently also water and solid portions such as sand in addition to oil, that the efficiency of the pump apparatus used falls as the gas portion in the multiphase mixture rises. The use of pump apparatus having radial impellers is, for example, already no longer possible or no longer economic at low gas densities from a volumetric gas/liquid ratio of more than 0.04 to 0.06. In conventional conveying plants, with a higher gas portion, the gaseous phase of the multiphase mixtures is therefore first separated from the liquid phase and the two phases are then conveyed separately at respectively different conveying conditions. Such a separation of the liquid phase and the gaseous phase of the multiphase mixture is not always possible or economic in dependence on the specific conditions of use at the site of conveying. Special pumping apparatus or compression apparatus were therefore developed to reduce the volumetric gas-to-liquid ratio of the multiphase mixtures to be conveyed so much that subsequently a conventional pump apparatus can be used for the further conveying, for example a displacement pump, a rotary pump or a jet pump.

Such pumping apparatus or compression apparatus for multiphase mixtures having an increased gas portion are already known, for example, from GB-A-1 561 454, EP 0 486 877 or U.S. Pat. No. 5,961,282.

The hybrid pump in accordance with U.S. Pat. No. 5,961, 282, for example, is a system for the compression of a multiphase mixture which can in particular include a substantial gas portion in addition to a liquid phase. The pump in this respect includes a multistage axial flow pump for reducing the relative gas portion, i.e. the axial flow pump serves for increasing the density of the multiphase mixture so that it can finally be pumped by a further customary centrifugal pump from a lower level to a higher level, for example from the bottom of the sea to an oil platform, a ship or to a land-based plant.

As already mentioned, the helico-axial pump acting as a compressor includes a rotor having a plurality of compression stages, in practice, for example, having up to sixteen or more stages, so that the multiphase mixture can be compressed step-wise from a relatively low density having a high relative volume portion of gas up to a highly compressed multiphase mixture having such a high density that the highly compressed mixture can be conveyed onward using a conventional pump.

Figure 1B:
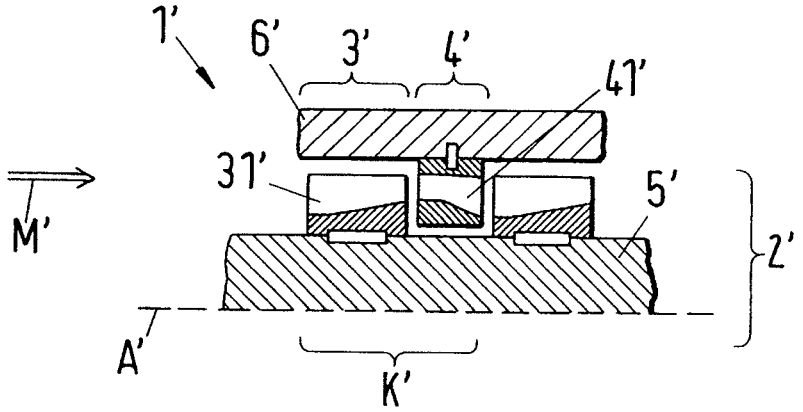

A compression stage K' know per se of a rotor 2' of a helico-axial pump 1' is shown schematically in FIG. 1*a* and FIG. 1*b*, wherein a section I-I of a section in accordance with FIG. 1*a* is shown parallel to the longitudinal axis A' for illustration in FIG. 1*b*.

Each compression stage K' in this respect includes a rotating impeller 3' having a screw 31', wherein the rotating impeller 3' is similar to a short Archimedean screw, and includes a stator 4' adjacent thereto which is made up of a plurality of static, that is not rotating, blades 41'. The impeller 3' and the stator 4' are in this respect mounted with respect to a common pump shaft 5' such that the impeller 3' is set into rotation by the pump shaft 5' in the operating state while the stator 4' is decoupled from the rotary movement of the pump shaft 5' and therefore does not rotate with respect to the impeller 3'. The pump shaft 5' in this respect extends along a longitudinal axis A'. The plurality of the compression stages L' are in this respect arranged in series behind one another in a substantially tubular pump housing 6'.

The rotating screws 31' conveys the multiphase mixture M' in the direction of the arrow e.g. from a preceding compression stage K' not shown in FIG. 1*a* and FIG. 1*b* into the stator 4', whereby kinetic energy is converted into pressure energy in the stator 4', which results in the compression of the multiphase mixture M'.

To obtain a sufficiently high compression of the multiphase mixture M', a larger number of compression stages K', for example up to sixteen or even more, has to be provided in series in practice, as already mentioned, each compression stage being made up of an impeller 3' and a stator 4' in series, which necessarily results in a considerable construction length of the helico-axial pump 1'.

The decisive disadvantage of such long rotors 2' formed from a plurality of compression stages K' is therefore that they can only be controlled with great difficulty vibration-wise. These long rotors 2' namely form a vibration-capable system in the interior of the tubular pump housing 6', said vibration-capable system in particular being able to form different transverse vibration modes which can be so intensive that the pump can no longer be operated at a preset number of revolutions or in a specific revolution field. Furthermore, the efficiency of the pumps 1' can also be reduced and in the worst case even damage to the pump 1' is to be feared if the rotor 2', for example, starts to vibrate so strongly and in such an uncontrolled manner that parts of the rotor 2', such as the impeller 3', come into contact with the pump housing, for example, due to the vibration movement. In this respect, the kind and the intensity of the vibrations of the rotor 2' do not only depend on the specific geometry, but rather also on the operating condition of the pump 1', of the multiphase mixture M' to be pumped, of the speed of the pump 1' and of further known, and in some cases not exactly known parameters so that it is hardly possible to cope with the problems with the damaging vibrations of the rotor 2' solely by an adaptation of the geometrical relationships of known pumps 1' or by using new materials.

In this respect, there is a clear desire for pumps having an ever higher number of compression stages so that multiphase mixtures with ever higher gas portions can be compressed better and better, that is to ever higher pressures, so that the multiphase mixture compressed in this manner can be pumped onward more reliably and over larger and larger pressure differences or height differences.

It is therefore the object of the invention to provide a helico-axial pump for the conveying of multiphase mixtures, in which the damaging vibrations of the rotor are largely avoided and the vibrations of the rotor are reduced or damped to a presettable degree so that, on the one hand, an improved running of the rotor can be achieved in the operating state and, on the other hand, the pump can be operated at speeds or in a revolution field in which the helico-axial pumps known from the prior art cannot be operated due to the above-described damaging vibrations of the rotor. In addition, the new pump should alternatively or simultaneously be equipped with more compression stages than in the pumps previously known in the prior art in which the length of the pump and thus the maximum number of compression stages is limited by the vibrations of the rotor in the operating state.

The subjects of the invention satisfying this object are characterized by the features of the independent claims of the respective category.

The dependent claims relate to particularly advantageous embodiments of the invention.

The invention thus relates to a helico-axial pump for conveying a multiphase mixture, which helico-axial pump includes a rotor rotatably journalled about a longitudinal axis in a pump housing and having a first part rotor and a second part rotor, wherein the first part rotor and the second part rotor include a compression stage having a helico-axial impeller and a stator for the compression of the multiphase mixture. In accordance with the invention, a hydrodynamic stabilization bush having a stabilization surface is provided and designed between the first part rotor and the second part rotor such that a stabilization gap is formed before the stabilization surface so that a hydrodynamic stabilization layer is formed from a stabilization medium in the stabilization gap in the operating state.

It is thus important for the invention that a hydrodynamic stabilization bush having a stabilization surface is provided in the pump housing so that a stabilization gap is formed before the stabilization surface, in which stabilization gap a hydrodynamic stabilization layer is formed in the operating state of the pump.

The rotor dynamics are thus decisively improved by the present invention because the damping and stiffness of the vibration-capable rotor system are decisively increased by the stabilization layer.

The damaging vibrations of the rotor are largely avoided by the formation of the stabilization layer in the stabilization gap before the stabilization surface of the stabilization bush and are reduced or damped to at least a presettable tolerable degree so that the pump can also be operated at a revolution speed or in a specific revolution field where this is no longer possible to date without using the stabilization layer in accordance with the invention. An even higher efficiency of the pump and a smoother, improved running of the rotor in the operating state can furthermore possibly be achieved. Which ultimately has the result that not only energy for the operation of the pump can be saved, but also the service intervals can be extended, whereby the costs associated therewith can be dramatically cut and the service life of the pump is simultaneously also substantially increased.

A further particular advantage is that it is possible for the first time by the invention to construct pumps with a much higher number of compression stages than was previously possible. The possible number of compression stages was previously restricted simply by the vibrations of the rotor which increase hugely as the number of compression stages increases. The rotor can be reliably stabilized over practically any desired length by the invention.

In this respect, in a helico-axial pump in accordance with the invention, the stabilization layer forms quasi-automatically in the stabilization gap before the stabilization surface of the hydrodynamic stabilization bush so that, in a simple embodiment which is, however, of particular importance in practice, no further construction measures have to be taken except for a suitable setting of the size or shape of the stabilization gap or of the stabilization bush and/or its stabilization area.

If the geometry of the stabilization gap is set in accordance with the demands in a helico-axial pump in accordance with the invention, a pressure difference is formed above the stabilization gap in the operating state between the multiphase mixture which is located in the first part rotor and the one which is located in the second part rotor such that a presettable flow of multiphase mixture is automatically adopted from the second part rotor over the stabilization gap back to the first part rotor, whereby a stabilization layer is automatically formed for the stabilization or damping of the damaging vibrations of the rotor.

In this respect, the degree, that this the amount of the damping, can be adapted in a simple manner in dependence on the technical demands or specifications in a helico-axial pump in accordance with the invention. This can take place, for example, by a suitable selection of the geometry, for example of the geometrical shape or width of the stabilization gap.

A helico-axial pump in accordance with the invention is in this respect particularly preferably configured in the form of a so-called back-to-back arrangement. A back-to-back arrangement is understood by the skilled person as an arrangement of two pump rotors in series which thus forms a pump with two pressure stages. The medium to be pumped is in this respect supplied via an intake opening of the pump to the first pressure stage, wherein the medium passes through the first pressure stage in a first axial direction, wherein in this respect the pressure of the medium to be pumped is increased to a first intermediate pressure. The medium is then supplied from the first pressure stage via a passage system to the second pressure stage such that the medium passes through the second pressure stage in a second axial direction which is opposite to the first axial direction of the first pressure stage. In the second pressure stage, the medium is then brought to the desired end pressure and is led off from the pump via a pressure opening for further use.

It is important in this respect for the back-to-back arrangement of the pumps known from the prior art, which are all not helico-axial pumps, that the direction of flow of the medium in the first pressure stage is opposite to the direction of flow in the second pressure stage. In the known pumps, the back-to-back arrangement namely serves only to at least partly compensate the huge thrust forces which act on the bearings of the pump shaft in the axial direction and thus to relieve the bearings. The huge axial thrust forces are in this respect due to the fact that very high pressures with very large components in the axial direction are produced in these pumps known from the prior art. Vibrations of the pump rotor play a very subordinate role here because the rotors as a rule do not have any great extent and/or are only made up of a respective one compression stage and/or an additional mechanical bearing, for example a ball bearing, is provided between the first pressure stage and the second pressure stage and additionally mechanically journals the pump rotor in the middle.

Since the axial pressure components in helico-axial pumps are rather small in comparison with other conventional pumps, the thrust forces which act on the bearings of the helico-axial pump in the axial direction do not play a decisive role. A back-to-back arrangement for helico-axial pumps was therefore also previously never taken into consideration because the known advantage of the back-to-back arrangement can actually not be exploited in helico-axial pumps.

The material recognition of the invention is therefore that the back-to-back arrangement can be used successfully in the case of helico-axial pumps when a stabilization bush in accordance with the invention is provided between the first part rotor and the second part rotor so that a stabilization layer of the stabilization medium can be formed in the stabilization gap due to the pressure drop between the first part rotor and the second part rotor, with the stabilization medium particularly preferably being the actual multiphase mixture to be pumped so that the vibrations of the rotor can be damped to a presettable non-damaging degree by the stabilization layer.

In a particularly preferred embodiment, the first part rotor and the second part rotor are thus provided in a back-to-back arrangement in the pump housing so that the multiphase mixture can be supplied via an intake opening to a first input compression stage of the first part rotor and can be led off again from the first part rotor into a first cross-passage via a first output compression stage. The multiphase mixture can then be supplied from the first cross-passage to a second input compression stage of the second part rotor and can be led off again via a second output compression stage from the second part rotor via a second cross-passage and a pressure opening from the helico-axial pump. In this respect, the first output compression stage and the second output compression stage are each arranged adjacent to the stabilization bush.

As will be explained later more exactly in the drawings, the stabilization bush is designed and arranged at the rotor in this respect such that the stabilization gap is formed between the stabilization bush and the pump housing. Simultaneously or alternatively, the stabilization bush can, however, be designed and arranged at the rotor such that the stabilization gap is formed between the stabilization bush and the rotor.

In an embodiment likewise important for practice, a hydrodynamic stabilization element having a stabilization surface is additionally provided and designed such that the stabilization gap is formed before the stabilization surface so that a hydrodynamic stabilization layer can be formed from the stabilization medium in the stabilization gap in the operating state, wherein the additional stabilization element is preferably a cover ring which surrounds the helico-axial impeller in the peripheral direction so that the stabilization gap is formed between the cover ring and the pump housing. In this respect, such a cover ring can be provided at all the helico-axial impellers of a rotor or only at selected individual impellers, whereby the manufacture of the rotor naturally becomes much less complex and less expensive.

In another important embodiment of the present invention, the additional stabilization element is provided in the form of a stabilization sleeve between two adjacent compression stages at the rotor, wherein a stabilization sleeve can be provided between all the adjacent compressor stages of a rotor, whereby a particularly good damping of the vibrations of the rotor can above all be achieved at very high loads or, however, also only between individual selected pairs of compression stages, whereby the manufacture of the rotor naturally becomes much less complex and less expensive.

The stabilization sleeve can in this respect be designed and arranged at the rotor such that the stabilization gap is formed between the stabilization sleeve and the pump housing and/or the stabilization sleeve can also be designed and arranged at the rotor such that the stabilization gap is formed between the stabilization sleeve and the rotor. Specifically, both variants can be realized at one and the same rotor, whereby a particularly smooth running and a particularly good damping of the rotor vibrations can be achieved in specific cases.

If the geometry of the stabilization gap of the additional hydrodynamic stabilization element is set in accordance with the demands in a helico-axial pump in accordance with the invention, a pressure difference is formed over the stabilization gap in the operating state between the multiphase mixture which is at a higher pressure level and that which is at a lower pressure level such that a presettable flow of multiphase mixture is automatically adopted over the stabilization gap from the higher pressure level back to the lower pressure level, whereby a stabilization layer is automatically formed for the additional stabilization or damping of the damaging vibrations of the rotor.

However, additional measures can also be taken for the formation of the hydrodynamic stabilization layer, in particular when the vibrations which occur are very high or when the damping should be set in dependence on specific operating parameters, such as the load at which the pump is operated, or in dependent on the number of revolutions.

A multiphase mixture can thus particularly preferably be used which is already more highly compressed and which is taken from a compression stage in which the multiphase mixture is already more greatly compressed than it is compressed in the stage in which it is used for the formation of the stabilization layer. Alternatively or simultaneously, however, a multiphase mixture compressed in the same compression stage can be used for the formation of the hydrodynamic stabilization layer, which will be explained in detail with reference to FIG. 4, for example. For this purpose, for example, special passages or lines can be provided in or at the pump housing which connect a supply opening for the supply of the multiphase mixture into the stabilization gap to the pressure output of a presettable compression stage.

It is understood in this respect that the stabilization medium for the formation of the stabilization layer can also be provided by other external sources in specific cases, for example by a pressure reservoir or by a pump which provides the medium for the formation of the stabilization layer for introduction into the stabilization gap at a presettable pressure, specifically at a pressure which can be controlled and/or regulated. The stabilization medium for the formation of the stabilization layer also does not necessarily have to be the multiphase mixture to be pumped, but can also be another stabilization medium, e.g. an oil, water or another liquid or gaseous stabilization medium or a fluid.

It is furthermore possible, for example, that the pressure of the multiphase mixture introduced into the stabilization gap is controlled and/or regulated by means of a valve known per se. It is also possible, for example, to supply the multiphase mixture to the stabilization gap simultaneously or alternatively from different compression stages, whereby the pressure in the stabilization gap and thus the degree of damping or of stiffness of the vibration-capable rotor can therefore be set in a very simple manner and can be adapted very flexibly to different demands and changing operating conditions.

As will be explained later with reference to the drawings by way of example for particularly preferred embodiments, the stabilization gap can be provided at the additional stabilization element and naturally also at the stabilization bush, for example between the stabilization surface and the pump housing and/or also between the stabilization surface and the rotor.

In this respect, in a particularly preferred embodiment of the present invention, a supply passage can be provided which is made and arranged such that a multiphase mixture at a presettable pressure and, resulting therefrom, a presettable quantity of multiphase mixture, can be supplied through the supply passage to the stabilization gap, with the supply passage preferably being provided in a gap ring, for the formation of the hydrodynamic stabilization layer in the stabilization gap.

The stabilization element can thus, for example, be designed as a stator having a supply passage, wherein the supply passage is formed and arranged at the stator such that a presettable quantity of a stabilization medium, in particular of a multiphase mixture, can be supplied at a presettable pressure through the supply passage to the stabilization gap for the formation of the hydrodynamic stabilization layer in the stabilization gap.

In a further embodiment variant, the supply passage can be arranged and formed at the pump housing such that a presettable quantity of stabilization medium, in particular of multiphase mixture, can be supplied through the supply passage to the stabilization gap for the formation of the hydrodynamic stabilization layer in the stabilization gap.

Or, however, a supply passage is arranged and formed at the rotor such that a presettable quantity of stabilization medium, in particular of multiphase mixture, can be supplied through the supply passage to the stabilization gap for the formation of the hydrodynamic stabilization layer in the stabilization gap.

As already mentioned, in a helico-axial pump in accordance with the invention, the stabilization medium, in particular the multiphase mixture can in particular be supplied to the supply passage, particularly preferably from a compression stage, at which a higher pressure level is present than at that compression stage to which it is supplied as the stabilization medium. Alternatively or simultaneously, however, a multiphase mixture compressed in the same compression stage can also be used for the formation of the hydrodynamic stabilization layer.

The invention furthermore relates to a rotor for arrangement in a pump housing of a helico-axial pump for conveying a multiphase mixture. In this respect, the rotor, which is rotatably journallable about a longitudinal axis, includes a first part rotor and a second part rotor; and the first part rotor and the second part rotor include a compression stage having a helico-axial impeller and a stator for the compression of the multiphase mixture. In accordance with the invention, a hydrodynamic stabilization bush having a stabilization surface is provided and designed between the first part rotor and the second part rotor such that a stabilization gap can be formed before the stabilization surface so that a hydrodynamic stabilization layer can be formed from a stabilization medium in the stabilization gap in the operating state.

In a special embodiment, an additional hydrodynamic stabilization element having a stabilization surface can be provided in the form of a cover ring which surrounds the helico-axial impeller in the peripheral direction so that the stabilization gap can be formed between the cover ring and a pump housing of the helico-axial pump. Alternatively or simultaneously, the hydrodynamic stabilization element can, however, also be a stabilization sleeve which is provided, for example, between two adjacent compression stages so that the stabilization gap is formed between the stabilization sleeve and the pump housing.

A supply passage can specifically be provided which is made and arranged so that a presettable quantity of stabilization medium, in particular of multiphase medium, can be supplied through the supply passage to the stabilization gap for the formation of the hydrodynamic stabilization layer.

The invention further relates to a hybrid pump having a rotor in accordance with the invention for a helico-axial pump of the present invention for the conveying of a multiphase mixture.

Finally, the invention also relates to a method for the hydrodynamic journalling of a rotor in accordance with the invention in a helico-axial pump or in a hybrid pump in accordance with the present invention, wherein the rotor is rotatably journalled about a longitudinal axis in a pump housing and the rotor includes a compression stage having a helico-axial impeller and a stator for the compression of the multiphase mixture. In accordance with the invention, a hydrodynamic stabilization bush having a stabilization surface is provided and designed in the pump housing such that a stabilization gap is formed before the stabilization surface so that a hydrodynamic stabilization layer is formed from a stabilization medium in the stabilization gap for the hydrodynamic journalling of the rotor in the operating state.

Figure 2:
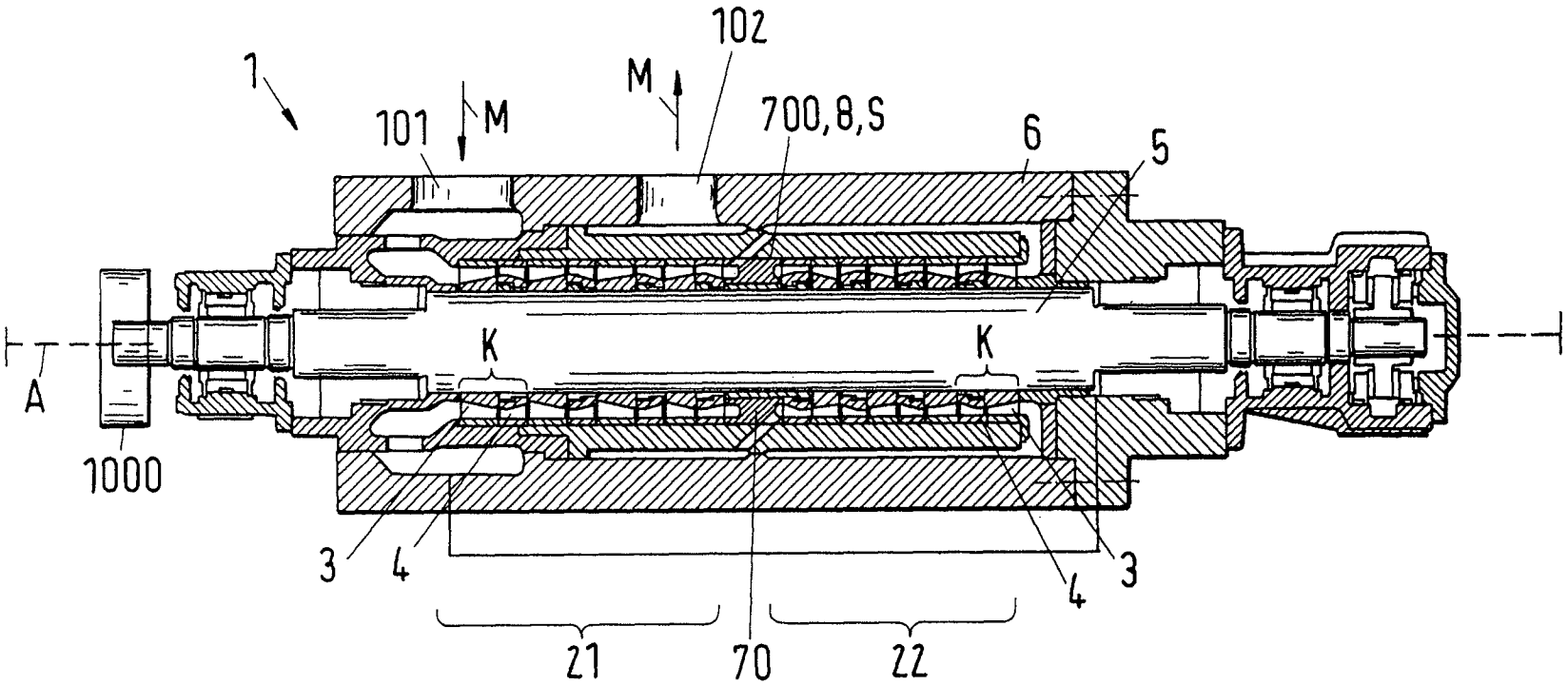
Figure 3:
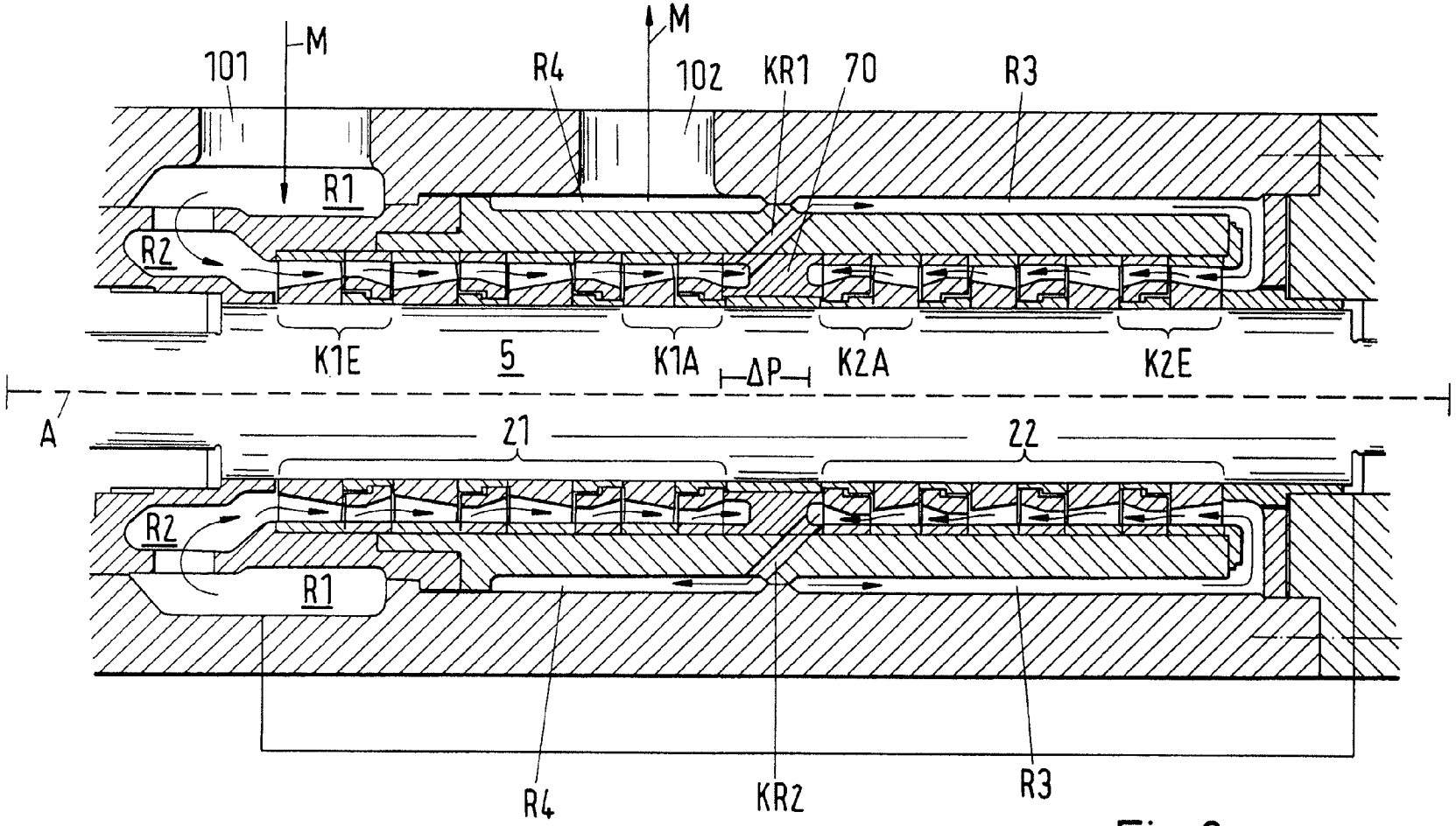
Figure 4:
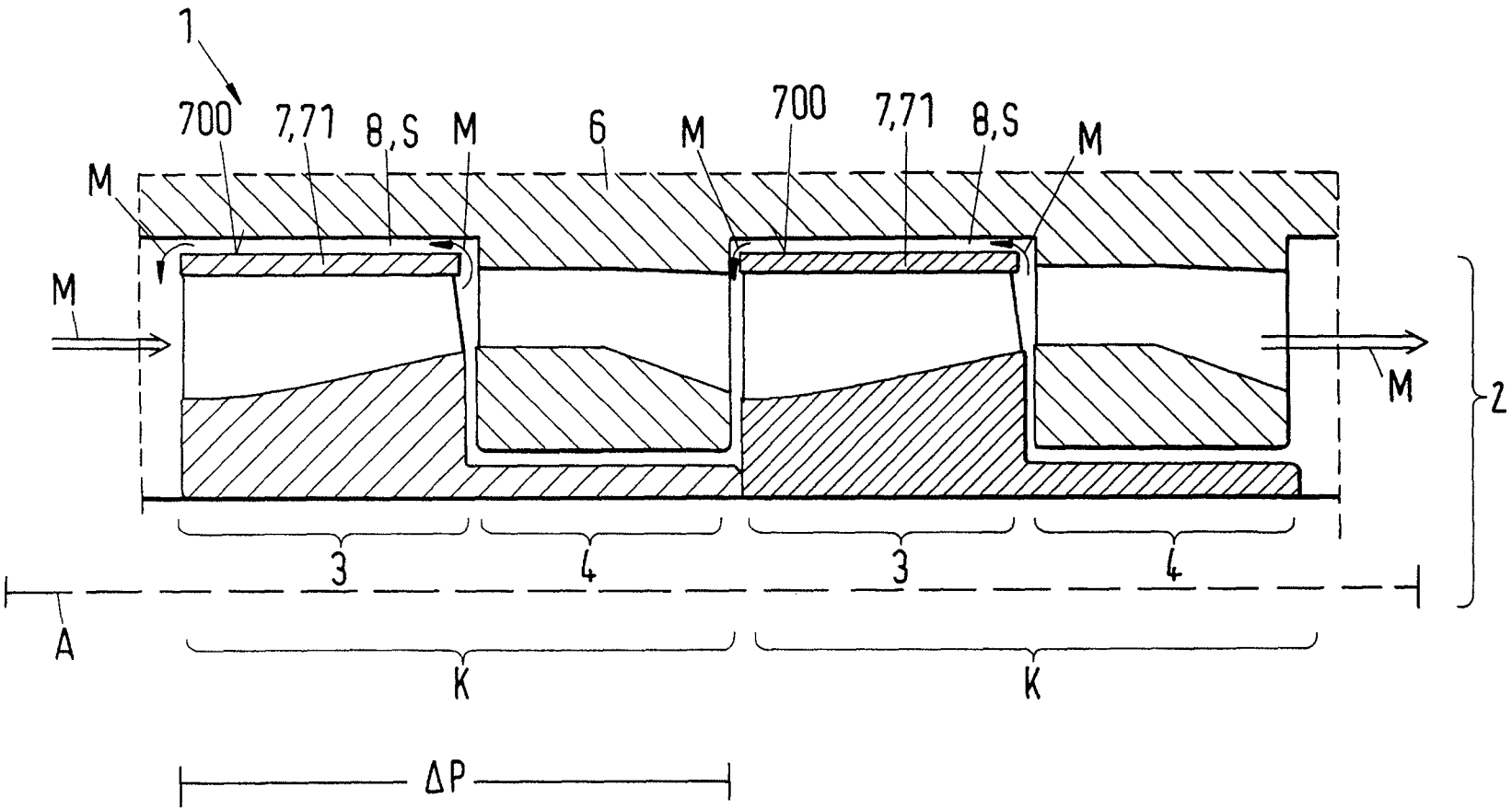
Figure 5A:
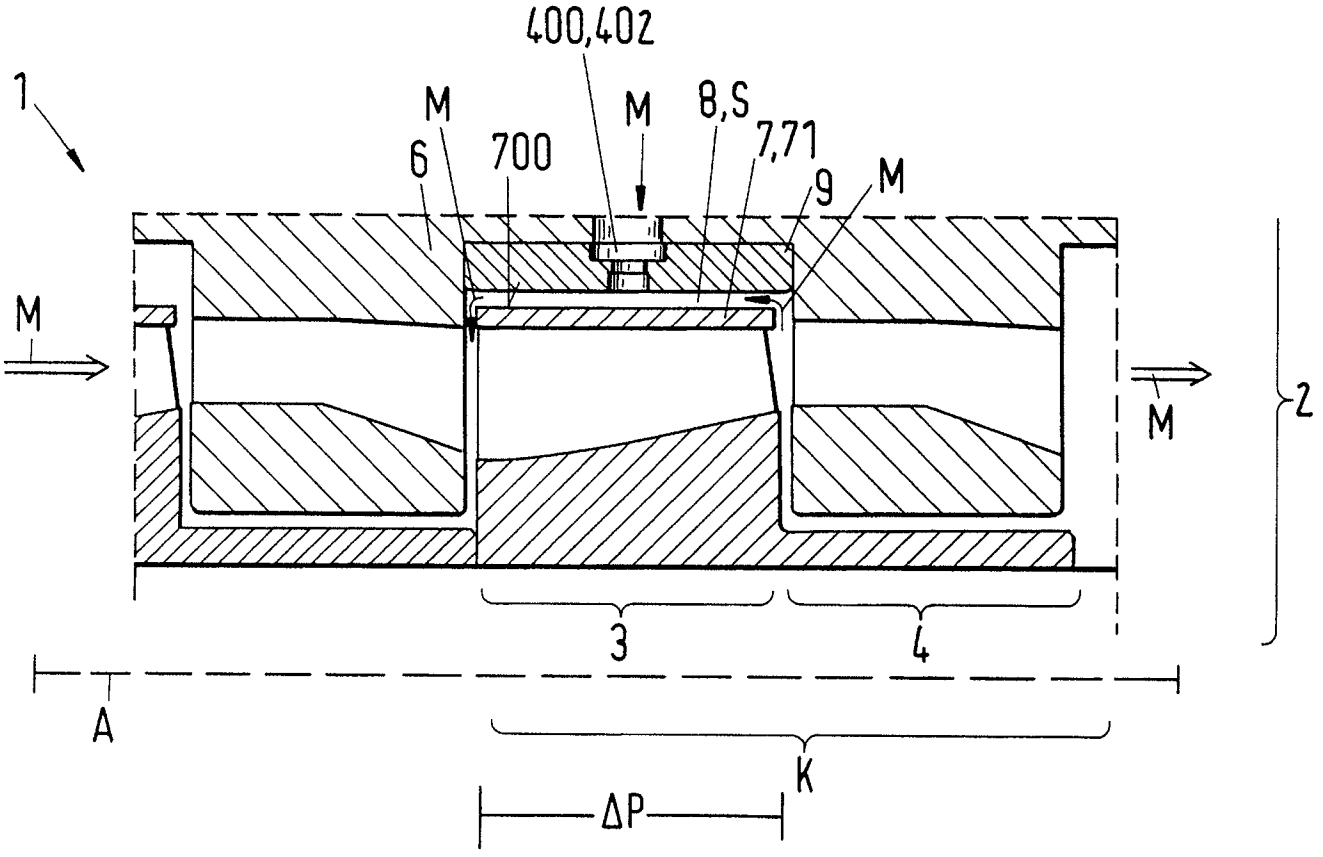
Figure 5B:
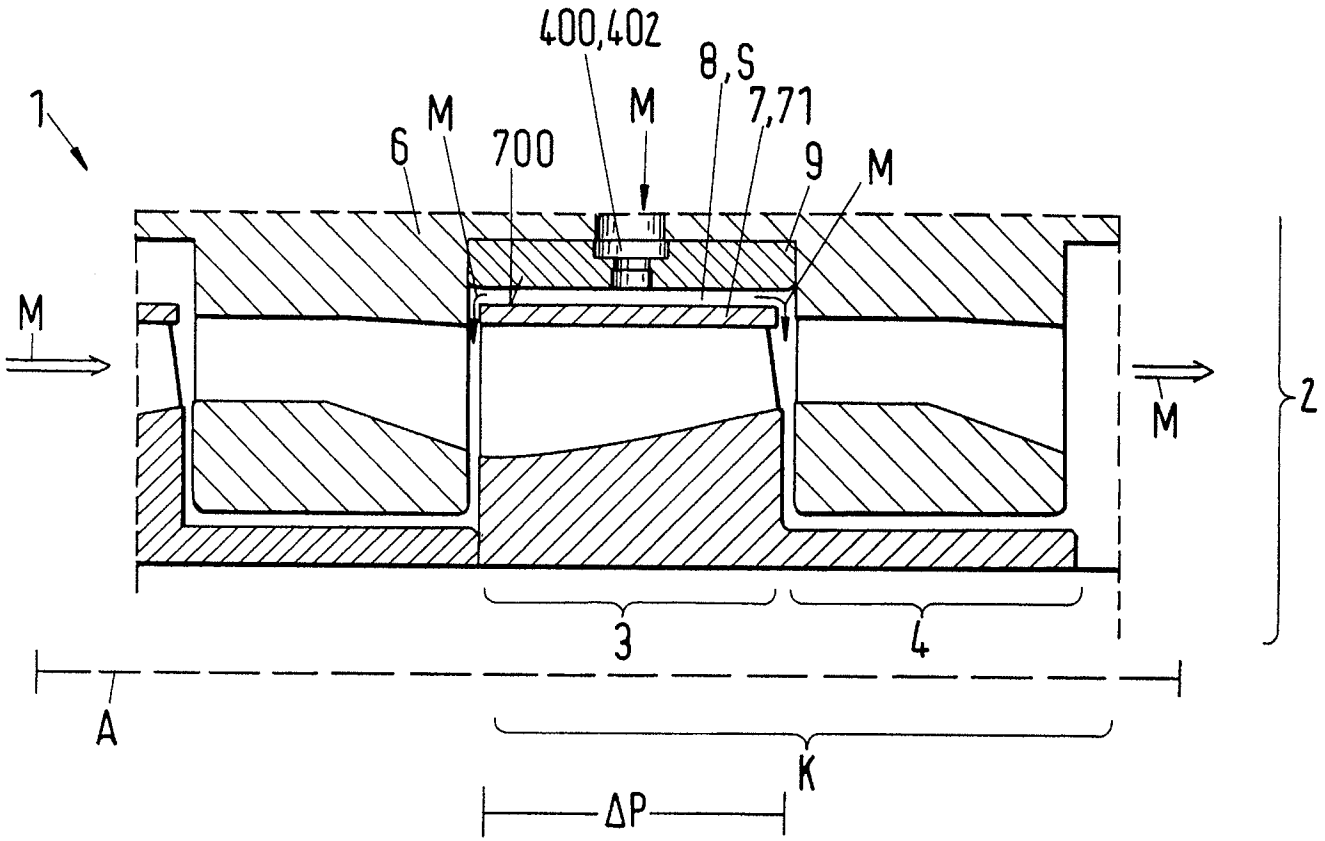
Figure 6A:
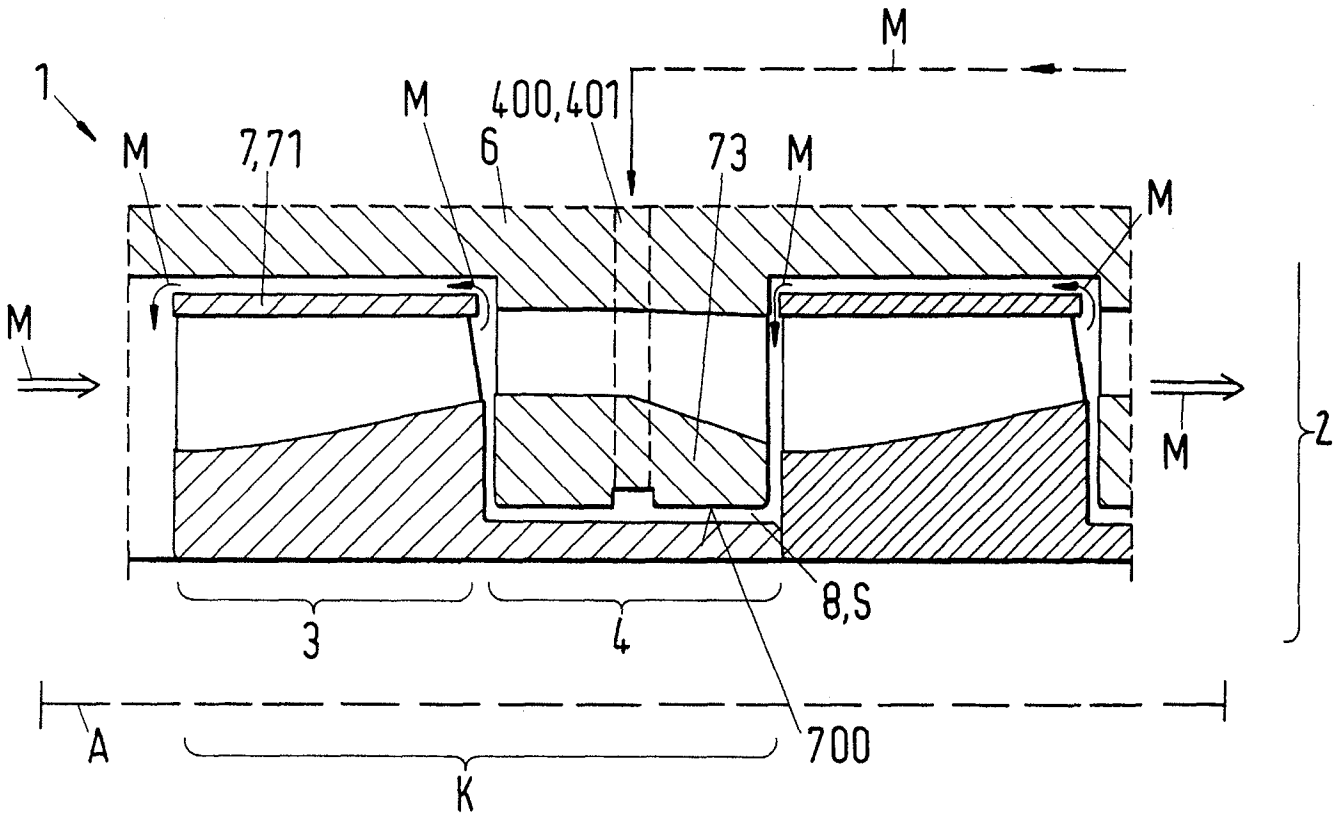
Figure 6B:
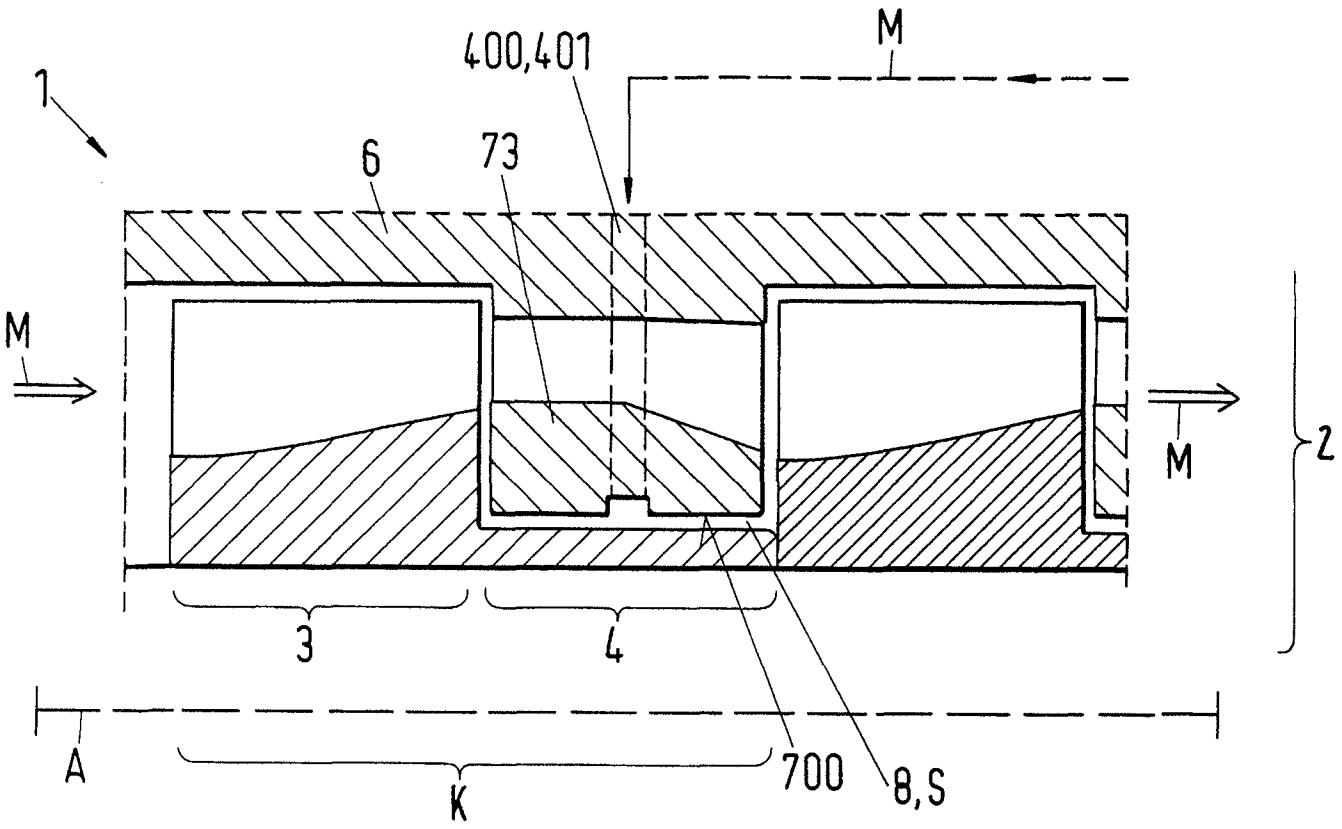
Figure 6C:
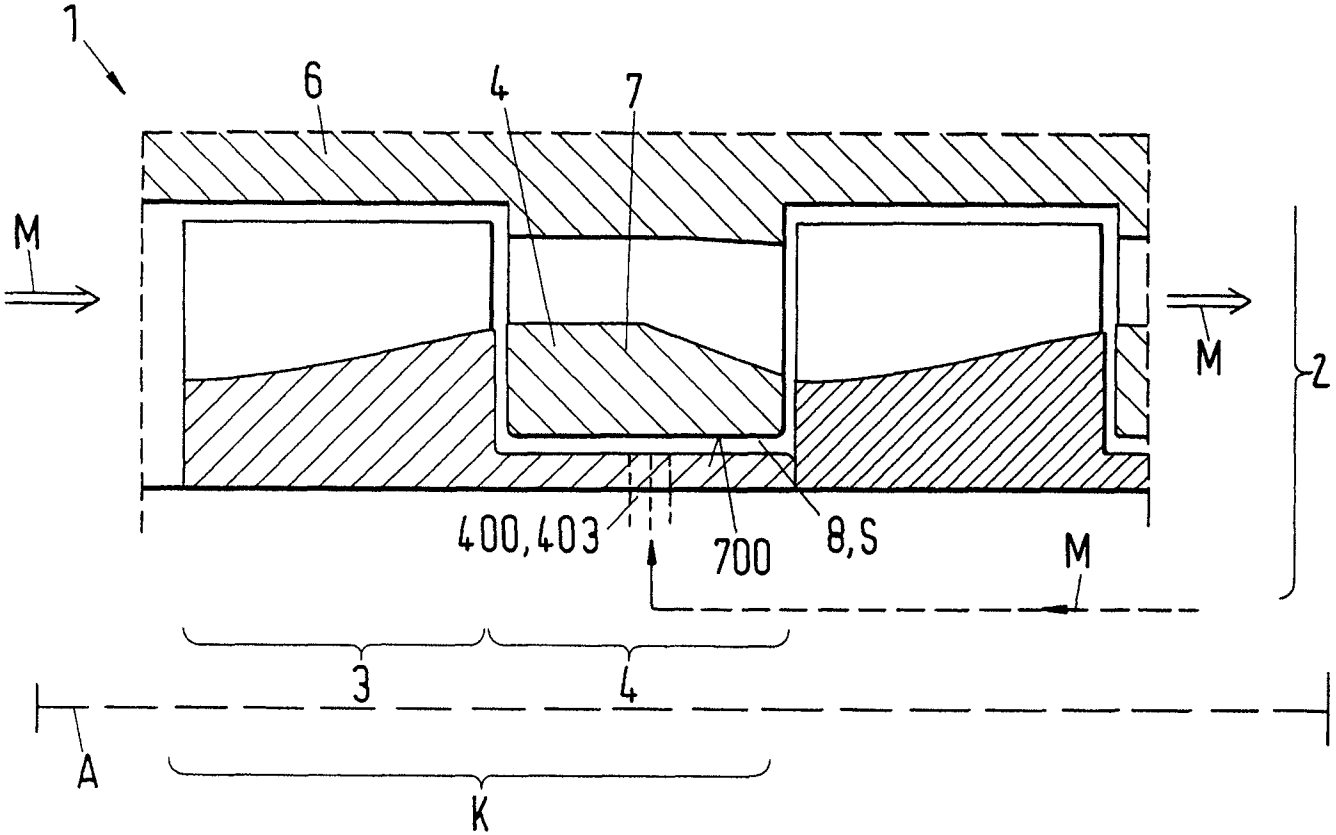
Figure 7A:
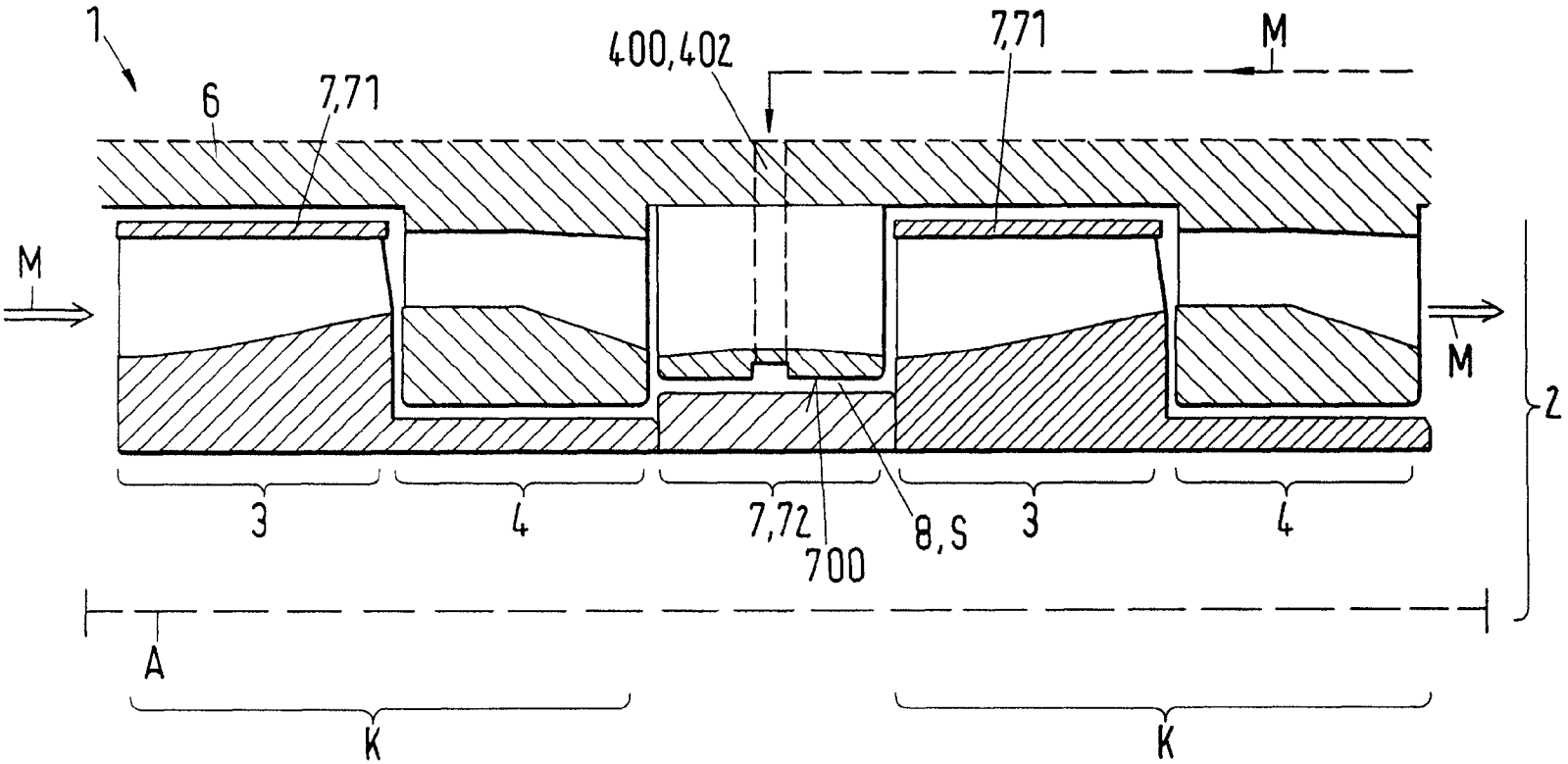
Figure 7B:
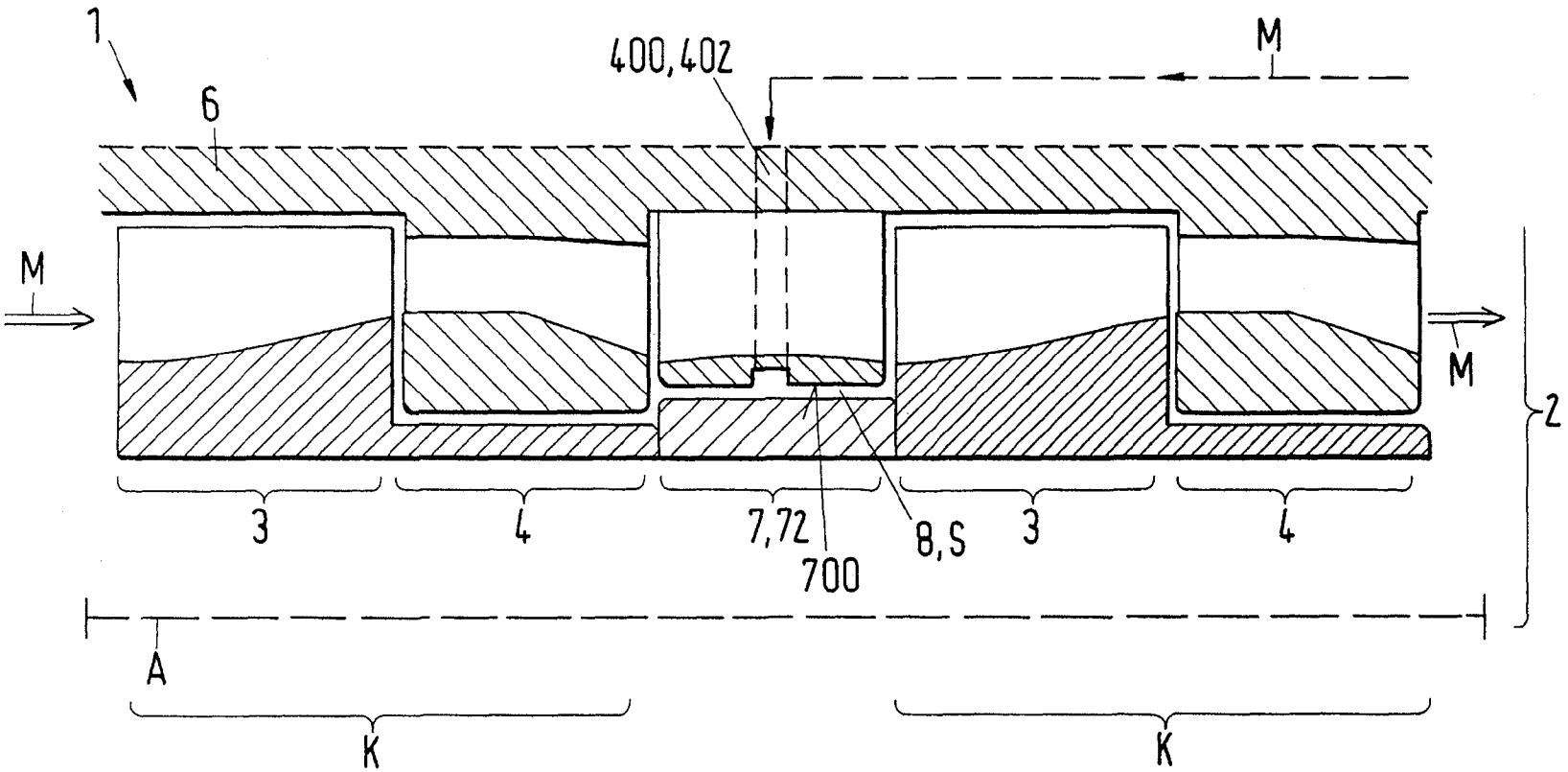

The invention will be explained in more detail in the following with reference to the drawing. There are shown in a schematic representation:

FIG. 1*a* a compression stage of a helico-axial pump known from the prior art;

FIG. 1*b* a pump in accordance with FIG. 1*a*, partly in section;

FIG. 2 an embodiment of a helico-axial pump in accordance with the invention in back-to-back arrangement;

FIG. 3 a detailed representation of the back-to-back arrangement in accordance with FIG. 2 in the operating state;

FIG. 4 an embodiment with an additional hydrodynamic stabilization element in the form of a cover ring;

FIG. 5*a* an embodiment of FIG. 4 with additional injection at the cover ring;

FIG. 5*b* the embodiment of FIG. 5*a* with injection at a higher pressure;

FIG. 6*a* a third embodiment in accordance with FIG. 4 with injection at the stator;

FIG. 6*b* another embodiment in accordance with FIG. 6*a* without a cover ring at the helico-axial impeller;

FIG. 6*c* a further embodiment in accordance with FIG. 6*b* with injection from the rotor;

FIG. 7*a* a fourth embodiment in accordance with FIG. 4 with a stabilization sleeve and injection; and FIG. 7*b* another embodiment in accordance with FIG. 7*a* without a cover ring at the helico-axial impeller.

The prior art described with reference to FIGS. 1*a* and 1*b* was already initially described in detail so that a further discussion of FIG. 1*a* and FIG. 1*b* is superfluous here.

it must be pointed out in another respect at this point that, for the better distinguishing of the invention from the prior art in the drawings, those reference numerals which relate to features or embodiments of the prior art are provided with a dash, whereas reference numerals for features of embodiments in accordance with the invention do not have a dash.

A first embodiment of a helico-axial pump in accordance with the invention in a back-to-back arrangement will be explained schematically with reference to FIG. 2.

The helico-axial pump 1 for conveying a multiphase mixture M in accordance with FIG. 2 includes a rotor 2 rotatably journalled about a longitudinal axis A in a pump housing 6 and having a first part rotor 21 and a second part rotor 22. The rotor 2 is driven by a drive 1000 which is an electric motor 1000, for example. The first part rotor 21 and the second part rotor 22 each include a plurality of compression stages K having a helico-axial impeller 3 and a stator 4 for the compression of the multiphase mixture M. In accordance with the present invention, a hydrodynamic stabilization bush 70 having a stabilization surface 700 is provided between the first part rotor 21 and the second part rotor 22 such that a stabilization gap is formed before the stabilization surface 700 so that a hydrodynamic stabilization layer S can be formed from a stabilization medium in the stabilization gap 8 in the operating state of the pump 1.

FIG. 3 shows a detailed representation of the back-to-back arrangement in accordance with FIG. 2 in the operating state of the helico-axial pump 1. As can be clearly recognized, the first part rotor 21 and the second part rotor 22 are arranged on a common pump shaft 5 in the pump housing 6 in a back-to-back arrangement. The first part rotor 21 and the second part rotor 22 are in this respect separated from one another by the stabilization bush 70. The multiphase mixture M is supplied via an intake opening 101, a first ring space R1 and a second ring space R2 to a first input compression stage K1E of the first part rotor 21 and is led off again via a first output compression stage KA1 from the first part rotor 21 into a first cross-passage KR1. Coming from the first cross-passage KR1, the multiphase mixture M is then supplied via a third ring space R3 to a second input compression stage K2E of the second part rotor 22 and is led off again via a second output compression stage K2A from the second part rotor 22 via a second cross-passage KR2, a fourth ring space R4 and a pressure opening 102 from the helico-axial pump for further use. To obtain a maximum pressure difference ΔP over the stabilization bush 70 and thus to ensure the formation of an ideal stabilization layer S in the stabilization gap 8, the first output compression stage K1A and the second output compression stage K2A are each arranged adjacent to the stabilization bush 70.

In the example of FIG. 3, the stabilization bush 70 is made and is arranged at the rotor 2 such that the stabilization gap 8 is formed between the stabilization bush 70 and the pump housing 6. As will be explained in more detail in a completely analog manner with reference to FIGS. 6*a* to 7*b*, the stabilization bush 70 can alternatively, or even simultaneously, also be made and arranged at the rotor 2 such that the stabilization gap s is formed between the stabilization bush 70 and the rotor 2.

An embodiment having an additional stabilization element in the form of a cover ring will be briefly discussed with reference to FIG. 4*a* which shows a section having two adjacent compression stages K of a rotor 2 in accordance with the invention in a schematic representation.

The rotor 2 of the helico-axial pump 1 is rotatably journalled about a longitudinal axis A in the pump housing 6. The rotor 2 in this respect includes, for the compression of the multiphase mixture M in a manner known per se, the compression stages K having an helico-axial impeller 3 and a stator 4.

In accordance with the present invention, in addition to the stabilization bush 70 not explicitly shown in FIG. 4*a*, a hydrodynamic stabilization element 7, 71 having a stabilization surface 700 is in this respect provided and made in the pump housing 6 such that a stabilization gap 8 is formed before the stabilization surface 700 so that a hydrodynamic stabilization layer S is also formed here from the multiphase mixture M in the stabilization gap 8 in the operating state.

In the present example of FIG. 4, the additional stabilization element 7 is a cover ring 71 which surrounds the helico-axial impeller 3 in the peripheral direction so that the stabilization gap 8 can be formed between the cover ring 71 and the pump housing 6.

For reasons of clarity, in each case only one or two compression stages K are in this respect shown in all the following Figures. Even if it is possible in principle that a helico-axial pump 1 in accordance with the invention only includes one single compression stage K, a helico-axial pump 1 in accordance with the invention, i.e. the first part rotor 21 and the second part rotor 22, will in practice include a plurality of compression stages K, for example up to sixteen compression stages K or even many more compression stages K, which are preferably arranged in series behind one another along the longitudinal axis A, so that a sufficient total compression of the multiphase mixture M can be produced in a manner known per se and the multiphase mixture M compressed in this manner can then, for example, be conveyed by a downstream pressure pump to a higher level and/or over long distances for further processing.

In the embodiment in accordance with FIG. 4, the stabilization layer S is formed from the stabilization medium M in the stabilization gap 8 in that the multiphase mixture M, as shown symbolically by the double arrow M, is supplied from the left to the compression stage K at the left in accordance with the drawing and is compressed by this in a manner known per se, which is naturally accompanied by a corresponding pressure increase which is also established as a pressure difference ΔP via the helico-axial impeller 3 compression stage K.

Due to the pressure difference ΔP, multiphase mixture M is pressed, as indicated by the small curved arrows M, from the higher pressure level shown at the right in accordance with the drawing into the stabilization gap 8, whereby the hydrodynamic stabilization level S is automatically formed between the stabilization surface 700 of the cover ring 7 and the pump housing 6, whereby the vibrations of the rotor 2 or of the part rotors 21, 22 are damped and the running of the rotor 2 is stabilized.

It is understood in this respect that, with a rotor 2 of the present invention, the cover ring 71 can be formed either at all helico-axial impellers 3 of the rotor or only at specific selected helico-axial impellers 3. In another respect, depending on the application or on the specific requirements, the cover ring 71 can completely cover a helico-axial impeller or a specific predeterminable region of the periphery of the helico-axial impeller 3.

A second embodiment in accordance with FIG. 4*a* is shown schematically with reference to FIG. 5*a* and differs from that of FIG. 4 in that an injection of the stabilization medium M is provided at the cover ring 71 of the helico-axial impeller 3. Here, stabilization medium M is additionally introduced through the supply passage 400, 402 into the stabilization gap 8 for the formation of the stabilization layer S. It is understood that here, as already described in the discussion of FIG. 4, a pressure difference ΔP will also be adopted above the helico-axial impeller 3 in the operating state, whereby the stabilization layer S is already partly formed. However, an even better stabilization layer S can be built up in the stabilization gap 8 by use of the injection of stabilization medium M at increased pressure through the supply passage 400, 402 so that very long rotors 2 or very heavily loaded rotors 2 can also still be sufficiently damped and reliably journalled.

In principle, an additional injection of stabilization medium can also take place into the stabilization gap S of the stabilization bush 70.

The embodiment of FIG. 5*b* in this respect only differs from that of FIG. 5*a* in that the injection of the stabilization medium M at the cover ring 71 of the helico-axial impeller 3 takes place at a much higher pressure than in the example of FIG. 5*a*. This can be clearly recognized by the fact that the stabilization medium M in FIG. 5*b* is pressed out of the stabilization gap 8, in accordance with the drawing, both to the left, that is in the direction toward a compression stage K having a lower pressure level, and to the right, that is also in the direction of a compression stage having a higher pressure level.

In contrast, in the example of FIG. 5*a*, the pressure at which the stabilization medium M is introduced through the supply passage 400, 402 into the stabilization gap 8 for the formation of the stabilization layer S is much smaller than in FIG. 3*a*. This can be clearly recognized by the fact that the stabilization medium M can enter into the stabilization gap 8 from the right in accordance with the drawing in FIG. 3, that is from a compression stage having a higher pressure level.

The stabilization medium M can in this respect, as already described, be provided by an external pressure reservoir or by an external pump; it, however, preferably provided by another compression stage K which has a higher pressure level.

A third embodiment in accordance with FIG. 4 having an injection of the stabilization medium at the stator 4 is shown with reference to the schematic FIG. 6*a*. A supply passage 400, 401 is provided here in the form of a bore at the stator 4, for example at a blade of the stator 4, or a separate supply passage 400, 401 can also be provided which, as shown in FIG. 6*a*, extends through the pump housing 6 up to the stabilization gap 8 so that a stabilization layer S in accordance with the invention of stabilization medium M is formed between the rotor 2 and the stabilization surface 700 of the stator 4 made as a stabilization element 73, said stabilization medium being able to be made in the specific example of FIG. 6*a* as multiphase mixture M from another compression stage.

Another embodiment in accordance with FIG. 6*a* is shown in FIG. 6*b* and only differs from that of FIG. 6*a* in that no cover ring 71 is provided at the helico-axial impeller 3. Such a simplified construction can, for example, always be successfully used when the stabilization of the rotor 2 by the stabilization layer S at the stator 4 is already sufficient.

FIG. 6*c* shows a further variant of the embodiment in accordance with FIG. 6*b*. Here, the supply of the stabilization medium M does not take place via a supply passage 400, 401 through the pump housing 5, but rather the injection of the stabilization medium M takes place through a supply passage 400, 403 which is formed in the rotor 2. For this purpose, the rotor 2 can, for example, have a hollow rotor shaft or suitable passages or lines can be formed in the rotor shaft through which the stabilization medium M, for example multiphase mixture M, can be supplied from a compression stage K having a higher pressure level.

In contrast, FIG. 7*a* shows a fourth, different embodiment in accordance with FIG. 4, in which an additional stabilization sleeve 72 is provided between two adjacent compression stages K, wherein injection of the stabilization medium M into the stabilization gap 8 takes place through the supply passage 400, 402 conducted through the pump housing 6. Such an arrangement is particularly suitable if a very high stability and/or damping of the rotor 2 has to be achieved. In this respect, the injection into the stabilization gap 8 can in principle also take place analog to FIG. 6*c* through the rotor shaft of the rotor 2. In addition, as is shown schematically in FIG. 7*b*, it is naturally also possible that the cover ring can be dispensed with at all or at different helico-axial impellers 3.

In this respect, it is naturally also possible in specific cases that, alternatively or additionally to the stabilization sleeve 72 between two respective adjacent compression stages K, a stabilization sleeve 72 can also be provided within a compression stage K between the helico-axial impeller 3 and the stator 4. In this respect, the skilled person immediately understands that a stabilization sleeve 72 does not have to be provided at each compression stage or between each pair of compression stages K.

It is understood that all the above-described embodiments of the invention are only to be understood as examples or by way of example and that the invention in particular, but not only, includes all suitable combinations of the described embodiments.

The invention claimed is:

1. A helico-axial pump for conveying a multiphase mixture, which helico-axial pump includes a rotor rotatably journalled about a longitudinal axis in a pump housing and having a first part rotor and a second part rotor, wherein the first part rotor and the second part rotor include a compression stage having a helico-axial impeller and a stator for the compression of the multiphase mixture, and wherein a hydrodynamic stabilization bush having a stabilization surface is provided and formed between the first part rotor and the second part rotor such that a stabilization gap is formed before the stabilization surface so that a hydrodynamic stabilization layer can be formed from a stabilization medium in the stabilization gap in the operating state.

2. A helico-axial pump in accordance with claim 1, wherein the first part rotor and the second part rotor are provided in a back-to-back arrangement in the pump housing such that the multiphase mixture can be supplied via an intake opening to a first input compression stage of the first part rotor and can be led off again from the first part rotor into a first cross-passage via a first output compression stage and the multiphase mixture can be supplied from the first cross-passage to a second input compression stage of the second part rotor and can be led off again from the second part rotor via a second output compression stage via a second cross-passage and a pressure opening from the helico-axial pump, wherein the first output compression stage and the second output compression stage are each arranged adjacent to the stabilization bush.

3. A helico-axial pump in accordance with claim 1, wherein the stabilization bush is made and is arranged at the rotor such that the stabilization gap is formed between the stabilization bush and the pump housing; and/or wherein the stabilization bush is made and is arranged at the rotor such that the stabilization gap is formed between the stabilization bush and the rotor.

4. A helico-axial pump in accordance with claim 1, wherein a hydrodynamic stabilization element having a stabilization surface is provided and is designed such that the stabilization gap is formed before the stabilization surface so that a hydrodynamic stabilization layer can be formed from the stabilization medium in the stabilization gap in the operating state.

5. A helico-axial pump in accordance with claim 4 wherein the hydrodynamic stabilization element is a cover ring which surrounds the helico-axial impeller in the peripheral direction so that the stabilization gap is formed between the cover ring and the pump housing; and/or wherein the hydrodynamic stabilization element is a stabilization sleeve so that the stabilization gap is formed between the stabilization sleeve and the pump housing.

6. A helico-axial pump in accordance with claim 4, wherein the stabilization element is the stator having a supply passage which is formed and arranged at the stator such that a presettable quantity of stabilization medium can be supplied through the supply passage to the stabilization gap for the formation of the hydrodynamic stabilization layer in the stabilization gap.

7. A helico-axial pump in accordance with claim 1, wherein a supply passage is provided which is made and arranged so that a presettable quantity of stabilization medium, in particular multiphase mixture, can be supplied through the supply passage to the stabilization gap for the formation of the hydrodynamic stabilization layer in the stabilization gap, wherein the supply passage is preferably provided in a gap ring.

8. A helico-axial pump in accordance with claim 7, wherein the stabilization medium is supplied to the supply passage from a compression stage at which a higher pressure level is present.

9. A helico-axial pump in accordance with claim 1, wherein a supply passage is arranged and formed at the pump housing such that a presettable quantity of stabilization medium can be supplied through the supply passage to the stabilization gap for the formation of the hydrodynamic stabilization layer in the stabilization gap.

10. A helico-axial pump in accordance with claim 1, wherein a supply passage is arranged and formed at the rotor such that a presettable quantity of stabilization medium can be supplied through the supply passage to the stabilization gap for the formation of the hydrodynamic stabilization layer in the stabilization gap.

11. A rotor for arrangement in a pump housing of a helico-axial pump in accordance with claim 1 for conveying a multiphase mixture, wherein the rotor rotatably journalled about a longitudinal axis includes a first part rotor and a second part rotor and the first part rotor and the second part rotor include a compression stage having a helico-axial impeller and a stator for the compression of the multiphase mixture, characterized in that a hydrodynamic stabilization bush having a stabilization surface is provided and formed between the first part rotor and the second part rotor such that a stabilization gap is formed before the stabilization surface so that a hydrodynamic stabilization layer can be formed from a stabilization medium in the stabilization gap in the operating state.

12. A rotor in accordance with claim 11, wherein a hydrodynamic stabilization element having a stabilization surface is provided in the form of a cover ring which surrounds the helico-axial impeller in the peripheral direction so that the stabilization gap can be formed between the cover ring and a pump housing of the helico-axial pump; and/or wherein the hydrodynamic stabilization element is a stabilization sleeve so that the stabilization gap is formed between the stabilization sleeve and the pump housing.

13. A rotor in accordance with claim 11, wherein a supply passage is provided which is made and is arranged such that a presettable quantity of stabilization medium, in particular multiphase mixture, can be supplied through the supply passage to the stabilization gap for the formation of the hydrodynamic stabilization layer in the stabilization gap.

14. A hybrid pump comprising a rotor rotatably journalled about a longitudinal axis in a pump housing and having a first part rotor and a second part rotor, wherein the first part rotor and the second part rotor include a compression stage having a helico-axial impeller and a stator for the compression of the multiphase mixture, a hydrodynamic stabilization bush having a stabilization surface and formed between the first part rotor and the second part rotor such that a stabilization gap is formed before the stabilization surface so that a hydrodynamic stabilization layer can be formed from a stabilization medium in the stabilization gap in the operating state, wherein the rotor rotatably journalled about a longitudinal axis includes a first part rotor and a second part rotor and the first part rotor and the second part rotor include a compression stage having a helico-axial impeller and a stator for the compression of the multiphase mixture, and a hydrodynamic stabilization bush having a stabilization surface and formed between the first part rotor and the second part rotor such that a stabilization gap is formed before the stabilization surface so that a hydrodynamic stabilization layer can be formed from a stabilization medium in the stabilization gap in the operating state.

15. A method for the hydrodynamic journalling of a rotor of a helico-axial pump, including a rotor rotatably journalled about a longitudinal axis in a pump housing and having a first part rotor and a second part rotor, wherein the first part rotor and the second part rotor include a compression stage having a helico-axial impeller and a stator for the compression of the multiphase mixture, a hydrodynamic stabilization bush having a stabilization surface and formed between the first part rotor and the second part rotor such that a stabilization gap is formed before the stabilization surface so that a hydrodynamic stabilization layer can be formed from a stabilization medium in the stabilization gap in the operating state, wherein the rotor rotatably journalled about a longitudinal axis includes a first part rotor and a second part rotor and the first part rotor and the second part rotor include a compression stage having a helico-axial impeller and a stator for the compression of the multiphase mixture, and a hydrodynamic stabilization bush having a stabilization surface and formed between the first part rotor and the second part rotor such that a stabilization gap is formed before the stabilization surface so that a hydrodynamic stabilization layer can be formed from a stabilization medium in the stabilization gap in the operating state, the method comprising rotatably journalling the rotor about a longitudinal axis in the pump housing for the compression of the multiphase mixture providing the rotor with a compression stage having a helico-axial impeller and a stator, and providing a hydrodynamic stabilization bush having a stabilization surface formed in the pump housing to thereby form a stabilization gap before the stabilization surface so that a hydrodynamic stabilization layer is formed from a stabilization medium in the stabilization gap for the hydrodynamic journalling of the rotor in the operating state.

* * * * *